US005217533A

United States Patent [19]

Hay et al.

[11] Patent Number: 5,217,533

[45] Date of Patent: Jun. 8, 1993

[54] COATING APPARATUS FOR CONTINUOUS FIBERS

[75] Inventors: Randall S. Hay; Edward E. Hermes, both of Beavercreek, Ohio

[73] Assignee: The United States of America as represented by the Secretary of the Air Force, Washington, D.C.

[21] Appl. No.: 726,484

[22] Filed: Jul. 8, 1991

[51] Int. Cl.[5] ..... B05C 3/12

[52] U.S. Cl. ..... 118/63; 118/405; 118/420; 118/DIG. 19

[58] Field of Search ..... 118/405, 420, DIG. 18, 118/DIG. 19, 63

[56] References Cited

U.S. PATENT DOCUMENTS

| | | | |
|---|---|---|---|
| 473,713 | 4/1892 | Reuter | 118/DIG. 19 |
| 2,127,413 | 8/1938 | Leguillon | 118/DIG. 19 |
| 2,194,565 | 3/1940 | Moss | 118/DIG. 19 |
| 2,366,077 | 12/1944 | Wildy et al. | 91/53 |
| 2,394,066 | 2/1946 | Kauth | 118/DIG. 19 |
| 2,591,505 | 4/1952 | Brink | 118/DIG. 18 |
| 3,265,033 | 8/1966 | Touze et al. | 118/420 |
| 3,346,413 | 10/1967 | Lindemann | 117/102 |
| 3,533,761 | 10/1970 | Pierson | 29/191 |
| 3,977,854 | 8/1976 | Fulmer et al. | 118/63 |
| 4,047,965 | 9/1977 | Karst et al. | 106/65 |
| 4,294,189 | 10/1981 | Ashida et al. | 118/603 |
| 4,294,190 | 10/1981 | Ohis | 118/620 |
| 4,411,710 | 10/1983 | Mochizuki et al. | 118/DIG. 19 |
| 4,522,148 | 6/1985 | Kassahon et al. | 118/405 |
| 4,671,911 | 6/1987 | Garnier et al. | 264/60 |
| 4,687,652 | 8/1987 | Yoldas et al. | 423/327 |
| 4,696,710 | 9/1987 | Minjolce et al. | 156/89 |
| 4,828,774 | 5/1987 | Andersson et al. | 264/60 |

FOREIGN PATENT DOCUMENTS

| | | | |
|---|---|---|---|
| 59-22684 | 2/1984 | Japan | 118/63 |

OTHER PUBLICATIONS

"Alomina Sol Preparation From Alkoxides", Bolent E. Yoldas, Ceramic Bull. vol. 54, No. 3 (1975) 289-90.

"Preparation of Glasses and Ceramics from Metal-Organic Compounds", B. E. Yoldas, J. Mat'l Sci, 12(1977) 1203-1208.

"Microstructure of Monolithic Materials formed by Heat Treatment of Chemically Polymerized Precursors . . . ", B. E. Yoldas, Cer. Bull. V59, N4, 479-83.

"Sol-Gel Processing of Ceramics and Glass" David W. Johnson, Jr., Cer. Bull. vol. 64 No. 12 (1985) 1597-1602.

*Primary Examiner*—W. Gary Jones

*Assistant Examiner*—Todd J. Burns

*Attorney, Agent, or Firm*—Charles E. Bricker; Donald J. Singer

[57] ABSTRACT

An apparatus for coating a continuous fiber which includes (a) a coating composition container having an orifice in the bottom portion thereof; (b) means for introducing coating composition into the coating container; (c) a catch vessel positioned below the orifice in the coating container; (d) means for deflecting excess coating composition flowing through the container orifice into the catch vessel; (e) means for removing coating composition from the catch vessel and returning the same to the coating container; and (f) means for transporting a continuous fiber to be coated through the orifice and the coating composition in the coating container; wherein the orifice in the coating container is of sufficient diameter that the continuous fiber need have no contact therewith, and preferably, has no contact therewith.

5 Claims, 2 Drawing Sheets

COATING APPARATUS FOR CONTINUOUS FIBERS

RIGHTS OF THE GOVERNMENT

The invention described herein may be manufactured and used by or for the Government of the United States for all governmental purposes without the payment of any royalty.

BACKGROUND OF THE INVENTION

This invention relates to an apparatus for the coating of continuous fibers. It also relates to a method for coating continuous fibers.

Composite materials are widely known and widely used. By combining a polymer with another material, such as glass, carbon, another polymer, or the like, is it possible to obtain unique combinations or levels of properties. Similarly, by combining a metal or glass with selected fibers, it is possible to obtain unique combinations or levels of properties. Advanced composites have evolved as a class of structural materials as a result of the development of high-modulus, high-strength, low-density reinforcing fibers.

The presence of a carbon interlayer along the fiber-matrix interface has been shown to be responsible for the high toughness and strain to failure of Nicalon® (SiC fiber)/lithium aluminosilicate glass composites and Nicalon®/Ba-Si-Al oxynitride glass composites. However, these composites are not viable for high temperature oxidizing environments. Such environments require oxidation resistant fibers, matrices and interlayers. One approach to fabricating a fiber-matrix interface is to introduce an interlayer as a fiber coating before the composite is densified. After densification, the interlayer chosen should cause crack deflection and fiber pullout similar to carbon interlayers, or should provide oxidation resistance for other interlayers.

Several types or combinations of interlayers are considered to be feasible, including microporous interlayers, reactive interlayers which lose volume, and interlayers with ductile particles. However, application of a coating, particularly a uniform coating, to continuous fibers and fiber tows can be difficult. Measurement of coating thickness can also be difficult.

Several techniques are known for applying coatings to continuous fibers. Fiber coating may be accomplished by passing the fibers through a container filled with a coating liquid, which container has one or more rollers or wheels to keep the fiber immersed in the liquid while coating. One disadvantage of this process is that the fibers must be bent around the roller(s) or wheel(s) and may sustain damage from bending or abrasion. Other disadvantages are that the fibers may be contaminated from contact with the wheel or roller and that fibers which do not tolerate a small bending radius are prone to breakage or require a very large wheel and container.

Coatings may also be applied by spraying. The primary disadvantage of this coating method is that spraying is a line of sight process, so coating thickness is dependent upon the angle at which the spray jet contacts the fiber. Other disadvantages are that spray jets tend to clog easily, the characteristics of the jet may change with time, making control of the process difficult, viscous coating solutions are difficult to apply as a spray, and low viscosity solutions tend to run off the fiber before they are cured.

Fibers may be coated by passing same through a container having a gasket which seals around the moving fiber and prevents coating liquid from flowing out. The disadvantages of this method are that the fiber surface may be contaminated or abraded by contact with the gasket, and fibers having irregular cross-sections or multifilament fibers or tows tend to get caught along irregularities or at broken fibers in gaskets tight enough to prevent leakage of the liquid.

It is an object of the present invention to provide an apparatus for coating continuous fibers.

It is a further object of the present invention to provide a method for coating continuous fibers.

Other objects, aspects and advantages of the present invention will become apparent to those skilled in the art from a reading of the following detailed description of the invention.

SUMMARY OF THE INVENTION

In accordance with the present invention, there is provided an apparatus for coating a continuous fiber which comprises:

(a) a coating composition container having an orifice in the bottom portion thereof;

(b) means for introducing coating composition into the coating composition container;

(c) a catch vessel positioned below the orifice in the coating composition container;

(d) means for deflecting excess coating composition flowing through the container orifice into the catch vessel;

(e) means for removing coating composition from the catch vessel and returning the same to the coating composition container; and (f) means for transporting a continuous fiber to be coated through the orifice and the coating composition in the coating composition container;

wherein the orifice in the coating composition container is of sufficient diameter that the continuous fiber need have no contact therewith, and preferably, has no contact therewith.

There is also provided a method for coating a continuous fiber which comprises the steps of: (a) transporting a fiber through a continuously flowing stream of a coating composition to provide a coated fiber having a layer of uncured coating thereon and (b) curing the coating on the fiber to provide a coated fiber having a layer of cured coating thereon, wherein the fiber has contact only with the coating composition between the uncoated state of the fiber prior to coating step (a) and the cured, coated state of the fiber subsequent to curing step (b).

DESCRIPTION OF THE PREFERRED EMBODIMENTS

Figure 1:
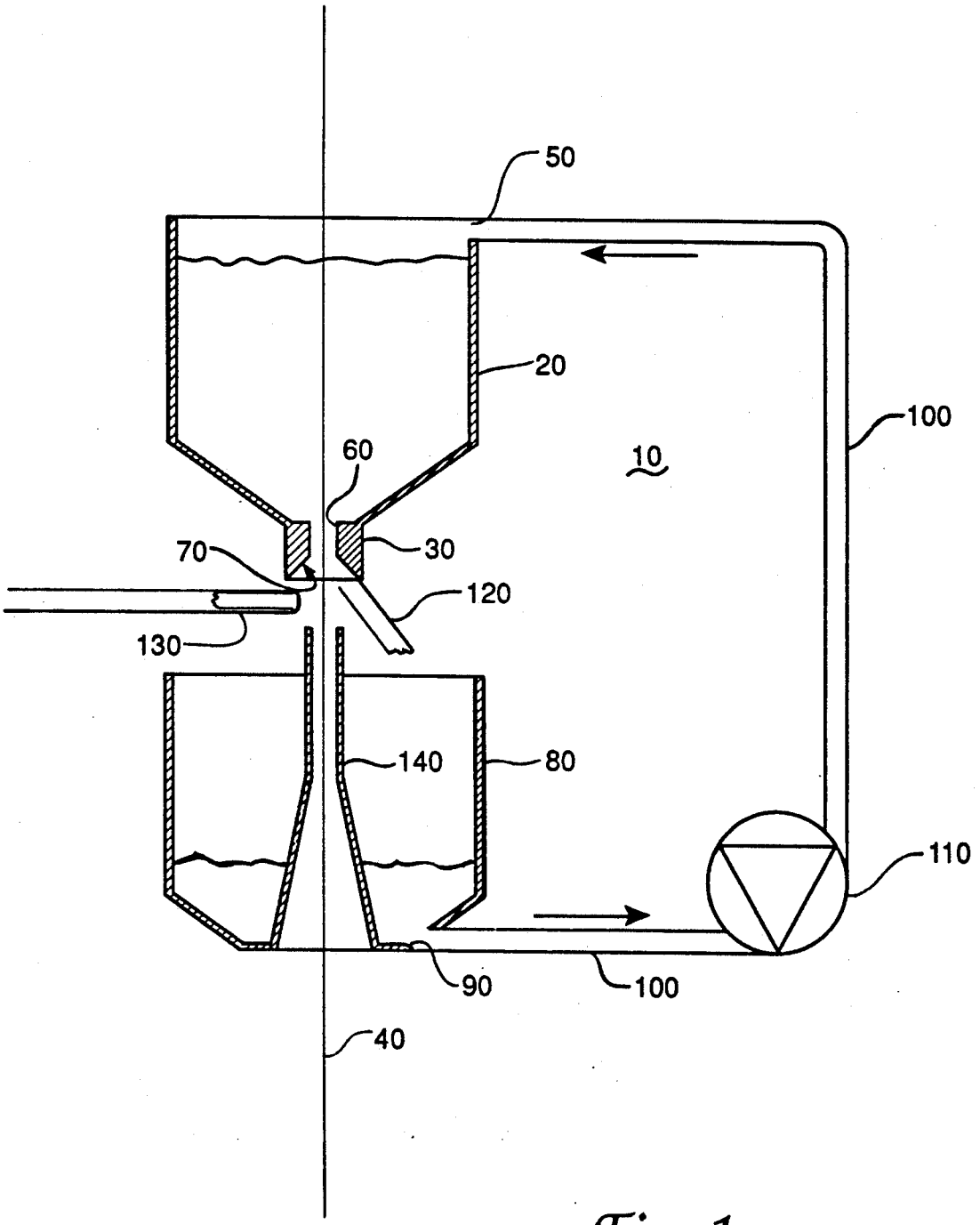
FIG. 1 illustrates the coating apparatus of this invention.

Referring to FIG. 1, the coating apparatus of this invention, designated generally by the numeral 10, comprises a coating composition container 20 having a nozzle 30 in the bottom portion thereof through which a continuous fiber 40 can be drawn. Inlet 50 is provided in container 20 for replenishing the coating composition.

Nozzle 30 has an throat passage or orifice 60 having an inner dimension sufficiently large that fiber 40 need have no contact therwith, even with vertical misalignment of fiber 40. Nozzle 30 has an exit portion 70 which flares downwardly and outwardly. Because passage 60 has a dimension greater than that of the fiber 40, the coating composition continuously flows through passage 60. Catch vessel 80 is positioned below nozzle 30 to catch excess coating composition flowing therethrough. The coating composition in vessel 80 is continuously removed through outlet 90 and recycled by way of various conduits 100 and pump 110 to inlet 50 of container 20. Catch vessel 80 is shown as having an upwardly extending funnel-shaped standpipe 140 through which fiber 40 can pass.

The nozzle 30 is preferably fabricated from a material which is wetted by the coating composition. When such a material is employed, the excess coating composition, after leaving passage 60, will follow the exit wall 70 and discharge into the catch vessel 80. Container 20 may optionally be provided with a deflector spout 120 and a gas jet 130 positioned so as to propel excess coating composition away from fiber 40 and into catch vessel 80.

The fibers employed according to the invention are high strength fibers such as, for example, carbon or graphite, silica, silicon carbide, silicon nitride, silicon carbide-coated boron, boron carbide-coated boron, silicon-coated silicon carbide, alumina, mullite, beryllium-titanium composites, boron-aluminosilicate, and the like. The fibers are employed as single continuous fibers, fiber tows, yarns, threads or cords.

The coating composition may be a clay slip or slurry, a solution of a metal salt or a polymer solution or a sol. A polymer solution is an inorganic oxide network containing glass- or ceramic-forming elements such as Si, Al, Ti, Zr and the like and, optionally, modifying elements such as Mg, B and the like. The oxide network is formed by controlled hydrolysis of an organo-metallic compound such as a metal alkoxide. The net reaction to form an anhydrous oxide is generally represented by:

$$M(OR)_n + xH_2O \longrightarrow M(OH)_x(OR)_{n-x} + xROH \quad (1)$$

$$M(OH)_x(OR)_{n-x} \longrightarrow MO_{n/2} + x/2H_2O + (n-x)ROH \quad (2)$$

The hydrolysis reaction (1) may be catalyzed by the addition of acid or base. Depending on pH and water content, the hydrolysis of, for example, tetraethylorthosilicate (TEOS) can result in the formation of polymeric species ranging from polysiloxane chains to colloidal particles of essentially pure silicon dioxide. Conditions employed in the preparation of monolithic glasses or ceramics normally consist of the hydrolyzation of the alkoxide precursors with a small to large excess of water (in equation 1, above, x greater than n/2) at low to intermediate pH (about 1 to 9). These conditions can result in structures that are intermediate between linear chains and colloidal particles. The oxide network can be dried, then thermally converted to glass or ceramic. Multicomponent glasses/ceramic may be similarly prepared.

For use in the present invention, a solution is prepared containing at least about 1 weight percent, preferably at least about 4 weight percent equivalent oxide. The metal alkoxides may be prepared using techniques known in the art. For example, silicon tetrakis isopropoxide may be prepared by reacting silicon tetrachloride with isopropyl alcohol. As another example, aluminum trisisopropoxide may be prepared by the reaction of aluminum metal foil with excess isopropyl alcohol using mercuric chloride as a catalyst.

The metal alkoxide may be diluted with a C1 to C4 alcohol, e.g., methanol, ethanol, n-propanol, i-propanol, n-butanol, i-butanol, t-butanol or sec-butanol, preferably with the alcohol corresponding to the alkoxide group, to a concentration sufficiently low to avoid gellation when later hydrolyzed, yet sufficiently high to provide the desired concentration of equivalent oxide.

The ceramic materials include silicates, aluminates, yttriates, titanates, zirconates, and the like, as well as combinations therof, such as the aluminosilicates, yttrium-aluminum garnet and yttrium-aluminum monoclinic. These materials may, optionally, be modified with one or more of boron, alkali metals, alkaline earth metals, lead and the like.

Figure 2:
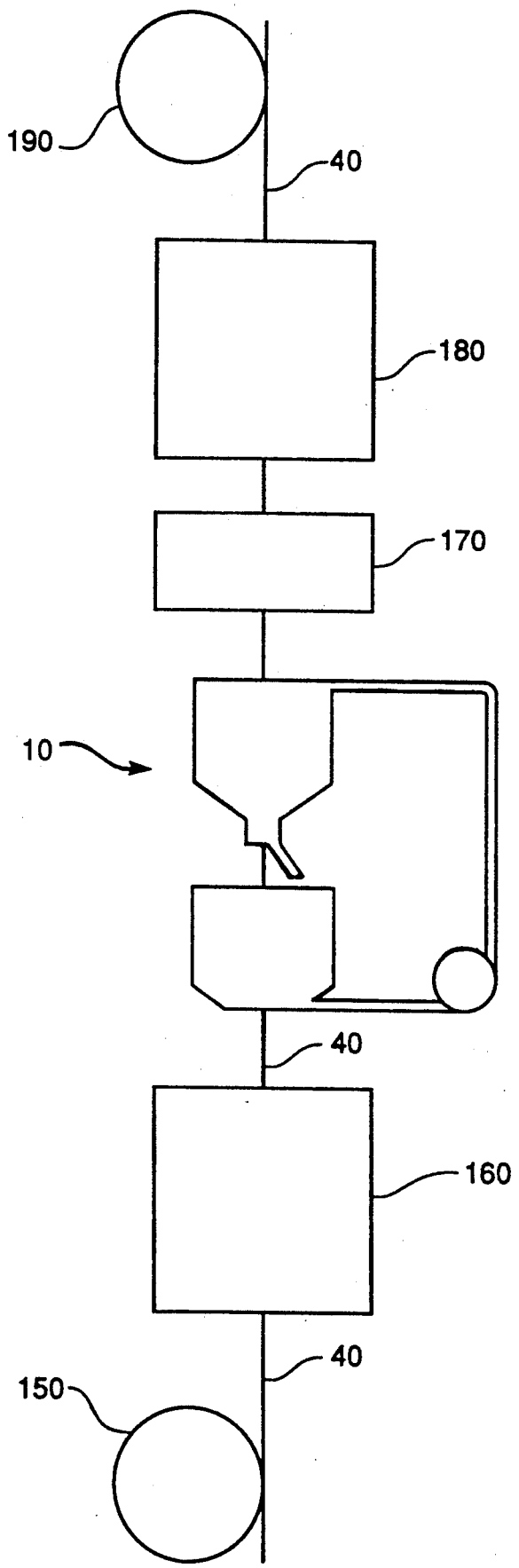
FIG. 2 illustrates an overall coating process.

FIG. 2 illustrates the overall process of this invention wherein uncoated continuous fiber 40 is provided from a source, not shown, to lower alignment and tensioning means 150 which aligns the fiber for a pass through the coating apparatus. Fiber 40 is passed through a first furnace 160, through the coating apparatus 10, through drying means 170, through a second furnace 180 to an upper alignment and tensioning means 190, thence to takeup means, not shown. The first furnace 160 is operated at a temperature sufficient to clean and/or burn off sizing from the fiber to be coated, i.e., about 500° to 1000° C.; this step may be omitted if the fiber is known to have a clean surface. The drying means 170 is operated at a temperature sufficient to drive off a majority of the coating composition liquid carrier, i.e., about 100° to 250° C. The second furnace 180 is preferably operated at a temperature sufficient to calcine the coating applied, i.e., about 750° to 1500° C.

The following examples illustrate the invention:

EXAMPLE I

Aluminum isopropoxide was prepared by the reaction of aluminum metal with dry isopropyl alcohol in the presence of mercuric chloride. Sols were made from the aluminum isopropoxide by controlled hydrolysis and peptization with acetic acid at 90° C. The solutions were thermally aged for seven days at 90° C. until a clear sol formed. Final solution pH was 5.0. Stock sol yield was 38 g/l alumina. Other sol concentrations were made by dilution or evaporation of the stock sol.

EXAMPLE II

A series of coating runs was made using silicon carbide monofilament (SCS-0, AVCO Corp.). The fibers were continuously coated with the above-described alumina sol at a variety of coating rates and sol concentrations. The coated fibers were heat-treated at several temperatures, as shown in Table I, below.

The coated fibers were characterized by optical microscopy in reflected light. The optical thickness of coatings measured from interference fringes was calibrated with monochromatic light and with a Mireau interferometer. Thickness was also measured from fracture cross-sections using a low voltage, high resolution SEM operating at 2 or 3 kV.

TABLE I

| Run No. | Calcining Temp (°C.) | Coating Rate (cm/s) | Sol Conc. (g/l) | Coating Thickness (μm) |
|---|---|---|---|---|
| 1 | 210 | 1.1 | 38.0 | 0.14 |
| 2 | 210 | 10.0 | 38.0 | 0.13 |
| 3 | 820 | 1.1 | 38.0 | 0.12 |
| 4 | 820 | 1.2 | 38.0 | 0.12 |
| 5 | 820 | 12.0 | 38.0 | 0.13 |
| 6 | 820 | 12.0 | 38.0 | 0.12 |
| 7 | 1080 | 0.32 | 38.0 | 0.11 |
| 8 | 1080 | 0.48 | 38.0 | 0.11 |
| 9 | 1080 | 7.6 | 38.0 | 0.11 |
| 10 | 1080 | 8.6 | 38.0 | 0.10 |
| 11 | 1080 | 25.0 | 38.0 | 0.12 |
| 12 | 1080 | 25.0 | 38.0 | 0.12 |
| 13 | 1080 | 43.0 | 38.0 | 0.14 |
| 14 | 1080 | 64.0 | 38.0 | 0.12 |
| 15 | 1150 | 2.3 | 7.6 | 0.05 |
| 16 | 1150 | 16.0 | 7.6 | 0.05 |
| 17 | 1150 | 38.0 | 7.6 | 0.05 |
| 18 | 1150 | 58.0 | 7.6 | 0.05 |
| 19 | 1150 | 1.5 | 23.0 | 0.07 |
| 20 | 1150 | 14.0 | 23.0 | 0.08 |
| 21 | 1150 | 36.0 | 23.0 | 0.11 |
| 22 | 1150 | 57.0 | 23.0 | 0.11 |
| 23 | 1150 | 0.93 | 118.0 | 0.36 |
| 24 | 1150 | 3.0 | 118.0 | 0.35 |
| 25 | 1150 | 12.0 | 118.0 | 0.38 |
| 26 | 1150 | 24.0 | 118.0 | 0.43 |
| *27 | 1150 | 8.1 | 118.0 | 0.75 |

*Coated twice.

In Runs 1 and 2 the heat treating temperature was too low to calcine the alumina. Accordingly, the coatings scraped off easily. These runs are included to illustrate that the apparatus of this invention could also be used to apply coatings such as aqueous latexes or the like.

It can be seen from runs 1–14, for which the sol concentration was 38.0 g/l, that the coating thickness was relatively independent of the coating rate. A comparison of the coating thickness for all runs indicates that coating thickness is a function of sol concentration. p The coating thickness was uniform over the range of coating rates, sol concentrations and heat treatment temperatures employed. Thick coatings were often so uniform that they had to be chipped so that a thickness wedge could allow measurement of the order of the interference fringes which defined the optical thickness. A uniform coating was defined as one that showed only slight color shifts in the Fizeau interference pattern corresponding to less than 0.05 μm difference in optical thickness over meter lengths of monofilament., and near complete absence of other inhomogenieties such as bubbles or precipitates.

The most non-uniform coatings were applied when the highest coating rates and sol concentrations were used together. It is believed that as concentration increased the sol viscosity increased, and at high velocity, a much thicker layer of the sol may have been dragged along the fiber. The thick liquid layer may have beaded, gelled and then calcined in that form.

Non-uniform coatings were also observed in runs 15–18 (sol concentration, 7.8 g/l) independent of the coating rate. On many areas of these filaments the coating is either not present or so thin it could not be detected from interference fringes.

At very low coating rates, all sol concentrations, there was a fine scale surface roughness to the coatings.

EXAMPLE III

A series of coating runs was made using alumina fiber tows (FP and PRD-166, DuPont). The tows were continuously coated with the above-described alumina sol at a variety of coating rates and sol concentrations.

Characterization of the coatings was more difficult on tows. The small difference between the index of refraction of the δ-alumina coating and the α-alumina tow fibers caused the intensity of the Fizeau fringes to be weak. Coating characteristics were more sensitive to coating rate, sol concentration and calcining temperature. Bridging of coating between individual filaments in the tows was also observed.

Various modifications may be made to the invention as described without departing from the spirit of the invention or the scope of the appended claims.

We claim:

1. An apparatus for coating a continuous fiber which comprises:

(a) a coating composition container having an orifice in the bottom portion thereof;

(b) means for introducing coating composition into the coating composition container;

(c) a catch vessel positioned below the orifice in the coating composition container;

(d) a gas jet for deflecting excess coating composition flowing through the container orifice into the catch vessel;

(e) means for removing coating composition from the catch vessel and returning the same to the coating composition container; and (f) means for transporting a continuous fiber to be coated through the orifice and the coating composition in the coating composition container;

wherein the orifice in the coating composition container is of sufficient diameter that the continuous fiber need have no contact therewith and that said coating composition can continuously flow therethrough.

2. The apparatus of claim 1 further comprising means for curing the coating on the thus-coated fiber.

3. The apparatus of claim 2 wherein said curing means consists essentially of calcining means.

4. The apparatus of claim 1 further comprising means for heating said fiber prior to transporting said fiber through said coating composition.

5. The apparatus of claim 1 wherein the orifice in the coating composition container is of sufficient diameter that the continuous fiber has no contact therewith.

* * * * *